United States Patent [19]

Uhrig

[11] 4,151,796

[45] May 1, 1979

[54] DEVICE FOR AUTOMATICALLY CONTROLLING DEVIATIONS IN LIQUID FEED IN OFFSET PRESSES

[75] Inventor: Rudolf Uhrig, Altenbach, Fed. Rep. of Germany

[73] Assignee: Heidelberger Druckmaschinen Aktiengesellschaft, Heidelberg, Fed. Rep. of Germany

[21] Appl. No.: 546,919

[22] Filed: Feb. 4, 1975

Related U.S. Application Data

[63] Continuation-in-part of Ser. No. 344,476, Apr. 2, 1973, abandoned.

[51] Int. Cl.[2] ..... B41F 7/04; B41F 7/32

[52] U.S. Cl. ..... 101/142; 101/148; 101/350

[58] Field of Search ..... 101/147, 142, 148, 349–352, 101/363, 364, 365, 206–210; 356/195, 212

[56] References Cited

U.S. PATENT DOCUMENTS

| | | | |
|---|---|---|---|
| 2,969,016 | 1/1961 | Crosfield et al. | 101/350 X |
| 3,185,024 | 5/1965 | McCreanor | 101/350 UX |
| 3,185,088 | 5/1965 | Norton | 101/426 |
| 3,234,871 | 2/1966 | Ostwald | 101/142 |
| 3,439,175 | 4/1969 | Kammüller et al. | 101/350 UX |
| 3,707,123 | 12/1972 | Heasman | 101/350 X |
| 3,835,777 | 9/1974 | Krygeris | 101/365 X |

*Primary Examiner*—Ronald E. Suter
*Attorney, Agent, or Firm*—Herbert L. Lerner

[57] ABSTRACT

A method of automatically controlling deviations in the liquid ink and dampening liquid feed in an offset printing press includes irradiating a layer formed of liquid ink and ingredients of a dampening liquid deposited on a plate cylinder of the press with at least one source of radiation, selectively interposing, in the radiation path between the radiation source and the irradiated liquid layer, wave length absorption filters, selecting certain wavelengths most heavily absorbed by at least one of the liquids, comparing measured values for the ink layer and the individual ingredients of the dampening liquid with a given nominal value and, in accordance with a quantitative deviation between the measured and the nominal values, automatically actuating a control circuit for regulating the feed of the liquid ink and the dampening liquid; and a device for carrying out the foregoing method.

1 Claim, 7 Drawing Figures

DEVICE FOR AUTOMATICALLY CONTROLLING DEVIATIONS IN LIQUID FEED IN OFFSET PRESSES

This application is a continuation-in-part of application Ser. No. 344,476, filed Apr. 2, 1973, and now abandoned.

The invention relates to method and device for automatically controlling deviations in the inking and dampening liquid guidance or feed in offset printing presses.

The deviations in the liquid ink and dampening liquid feed occurring in offset printing presses can be due to various causes. Disturbing factors which have been determined include, for example, a change of machine velocity, temperature, wear of the plate and start-up characteristics of the machine. The disturbing or disruptive factors often effect one another mutually or oppositely. Although methods and devices are known for controlling a dampening liquid and liquid ink in an offset printing process, none of the known methods or devices make a sufficiently precise allowance for the disturbing factors to determine, for example, the exact thickness of a liquid layer on a plate cylinder, without which an adequate control of such deviations is not possible.

It is an objective of the invention to automatically control the disturbing factors in order to maintain an optimal ink-and dampening liquid feed so as to assure a constant high quality of printing.

Measuring and control devices have become known which apply either to the ink or the dampening liquid layers. In perfecting such devices, it was assumed that, in order to achieve good printing, it was sufficient always to control either of the ink feed or the dampening liquid feed. What was not taken into consideration, however, was that the printing quality did not depend solely on this but also on a variable ratio of the ink feed to the dampening liquid feed within specific limits. Therefore, the necessity arose of automatically controlling both the ink as well as the dampening liquid feed simultaneously.

It is accordingly an object of the invention to provide a method and device for automatically controlling deviations in the inking and dampening liquid feed in offset printing presses which permits at minimal engineering cost, the rapid introduction and constant maintenance of the optimal ink and dampening liquid load within narrow tolerance limits.

With the foregoing and other objects in view, there is provided, in accordance with the invention, a method of automatically controlling deviations in liquid ink and dampening liquid feed in an offset printing press which comprises irradiating with at least one source of radiation a liquid layer formed of liquid ink and ingredients of a dampening liquid deposited on a plate cylinder of the press, selectively interposing, in the radiation path between the radiation source and the irradiated liquid layer, wavelength absorption filters selecting certain wavelengths most heavily absorbed by at least one of the liquids, comparing measured values for the ink layer and the individual ingredients of the dampening liquid with a given nominal value and, in accordance with a quantitative deviation between the measured and the nominal values automatically actuating a control circuit for regulating the feed of the liquid ink and the dampening liquid.

With the measuring and control method of the invention, the individual parameters of the liquid layer on the offset plate of the plate cylinder are able to be rapidly and properly determined and compared to a nominal empiric value, so as to avoid a very large accumulation of waste paper, for example at start-up, and at interruptions or changes of speed of the offset printing press. An offset printing press operating in accordance with this method is therefore able to maintain automatically a high printing quality throughout the entire number of copies.

In accordance with another feature of the method of the invention, reflection changes during the printing of the copies as a result of changes in structure of the plate, due to wear, oxidation and so forth a well as due to aging of the radiation source are eliminated with the aid of comparative measurements outside the absorption bands. This is effected, in accordance with the invention, by interposing in the radiation path before and after each measurement of the ink and of the dampening liquid, a filter which transmits part of the spectrum influenced or determined, for example, by the surface of the plate and the temperature, but not by ingredients of the dampening liquid and the ink layer of the plate cylinder, and which registers fluctuations of the radiation source. A comparison ray can then be compared to the measured ray. In this way, a required variation of the dampening liquid feed, due, for example, to wear of the offset plate, can be achieved in accordance with empirically predetermined rules or laws because the comparison ray registers the surface structure of the offset plate.

In accordance with another feature of the invention, the received radiation values are smoothed and disturbing elements are removed therefrom.

In accordance with another aspect of the invention there is provided a device for carrying out the method of automatically controlling deviations in liquid ink and dampening liquid feed in an offset printing press having a plate cylinder carrying an offset plate, comprising a measuring head, a light radiation source disposed in the measuring head and having a light path directed toward the offset plate of the plate cylinder, a plurality of filters in said measuring head for transmitting only wavelengths of the radiation source spectrum, adjustable synchronizer means mounted on a single-revolution shaft rotatable in synchronism with the plate cylinder, said filters being alternatingly introducible into the radiation path and the individual measuring intervals being selectable by said synchronizer means, said measuring head also including a radiation collector and a photoelectric cell, the radiation collector focussing radiation reflected from the surface of the plate cylinder and directing the same to the photoelectric cell, control means for receiving a signal emitted by the photoelectric cell in accordance with the intensity of the reflected radiation directed thereto and adjusting and smoothing means for regulating the feed of the liquid ink and dampening liquid in response to the control means and for removing disturbing elements from the signal emitted by the photoelectric cell.

In accordance with an additional feature of the invention, the adjusting means, for example, comprises control motors for the inking and dampening mechanisms of the offset printing press.

By interposing various filters in the radiation path, those wavelengths can be selected which are most greatly absorbed by the respective ink or by the dampening water. As is known, absorption of blue (cyanide) is measured with a red filter, absorption of red (magenta) with a green filter, and absorption of yellow with a blue filter, and thus also various resonance-absorption bands of water are determined preferably by interference filters, for example at 0.74, 0.96, 1.45, 1.155, 1.94, 2.92, 4,74 or 6.15 μm and so forth, depending upon the quantity to be measured.

The possibility furthermore exists of determining quantitatively the alcohol additive in an alcohol dampening mechanism, a filter for the respective absorption band being provided. If it is should furthermore be found necessary to also control the ultraviolet band for fluorescent printing inks, this can readily be accomplished by employing a suitable filter. It is only necessary to know the absorption bands of the substance or parameter to be measured.

It is a particular advantage of the device according to the invention that all measurements can be effected with only one measuring head and that, by the additional use of electronic coupling techniques, one parameter, e.g. the dampening liquid can be influenced or determined in dependence of other control parameters or factors.

Other features which are considered as characteristic for the invention are set forth in the appended claims.

Although the invention is illustrated and described herein as embodied in a method of, and device for automatically controlling deviations in the inking and dampening liquid feed in offset printing presses, it is nevertheless not intended to be limited to the details shown, since various modifications may be made therein without departing from the spirit of the invention and which are within the scope and range of equivalents of the appended claims.

The invention together with additional objects and advantages thereof will be best understood from the following description when read in connection with the accompanying drawings, in which.

Figure 3:
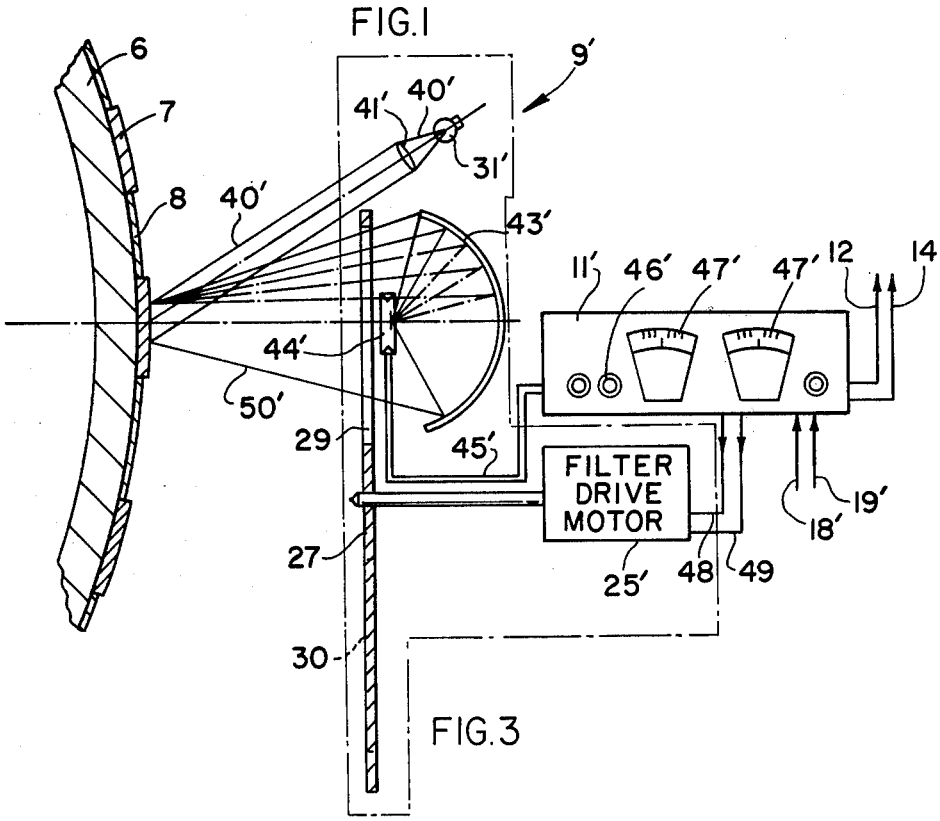
Figure 2:
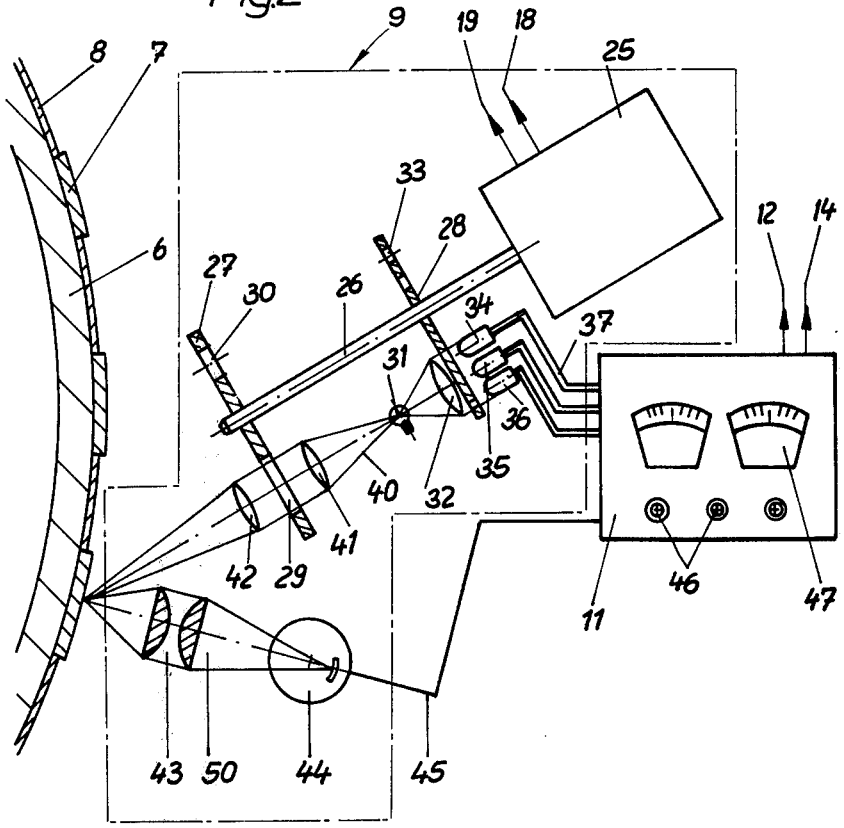
FIG. 2 is a fragmentary enlarged diagrammatic view of FIG. 1 showing the disposition of the components of the measuring head as well as a control device not part of the measuring head.
Figure 2A:
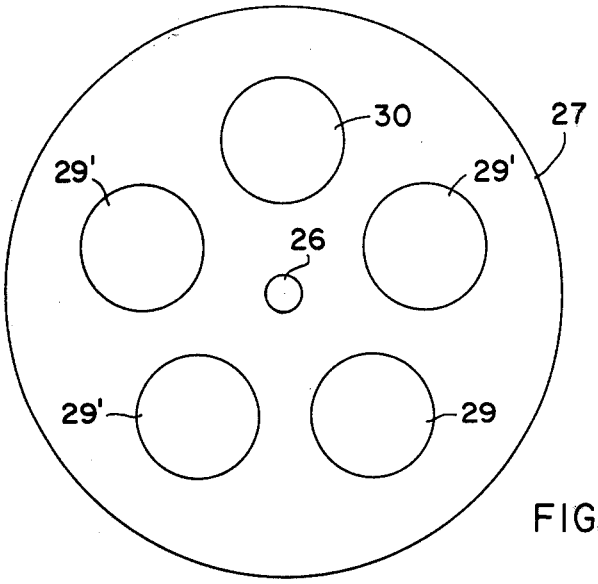
Figure 4A:
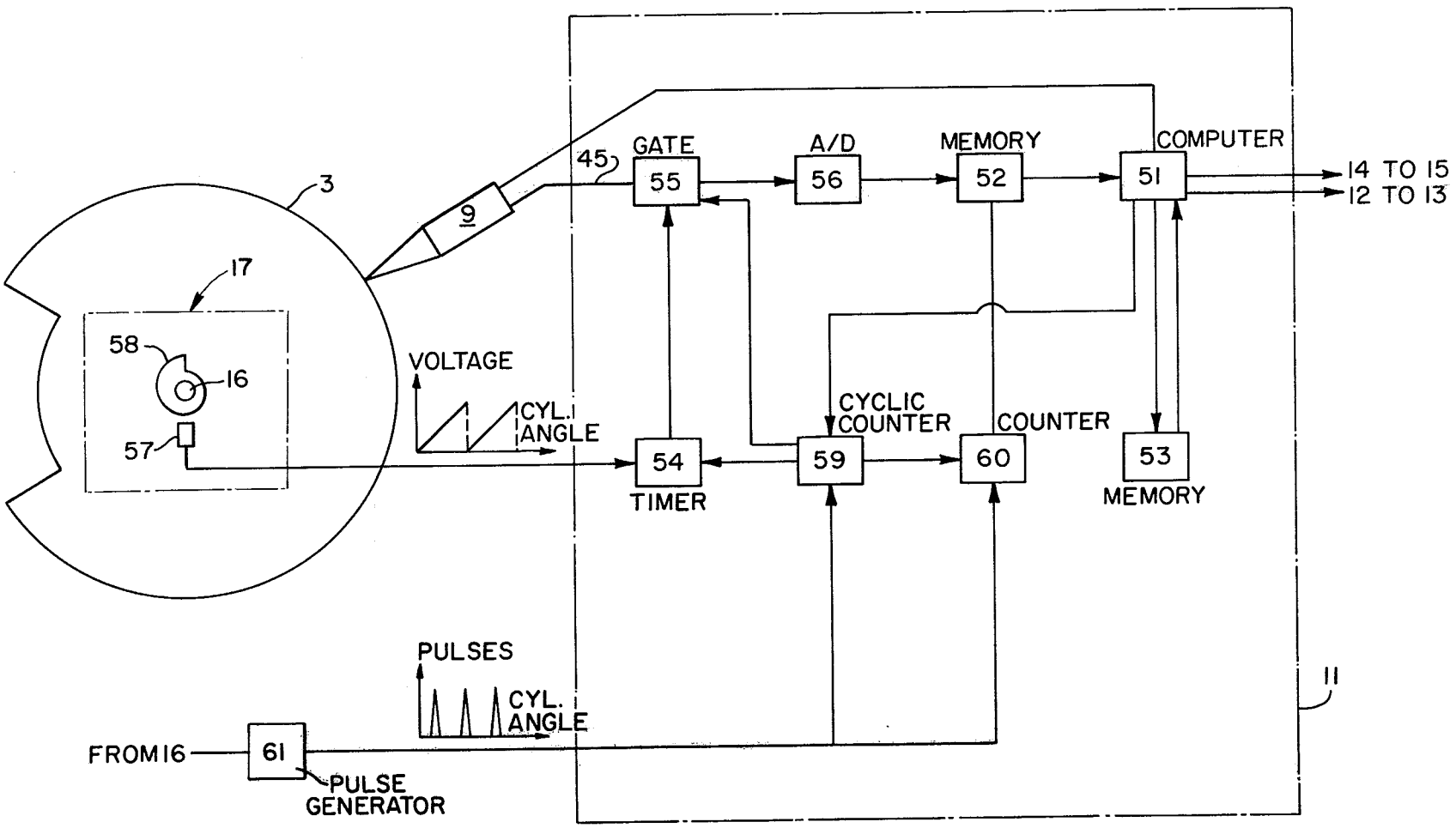
Figure 4B:
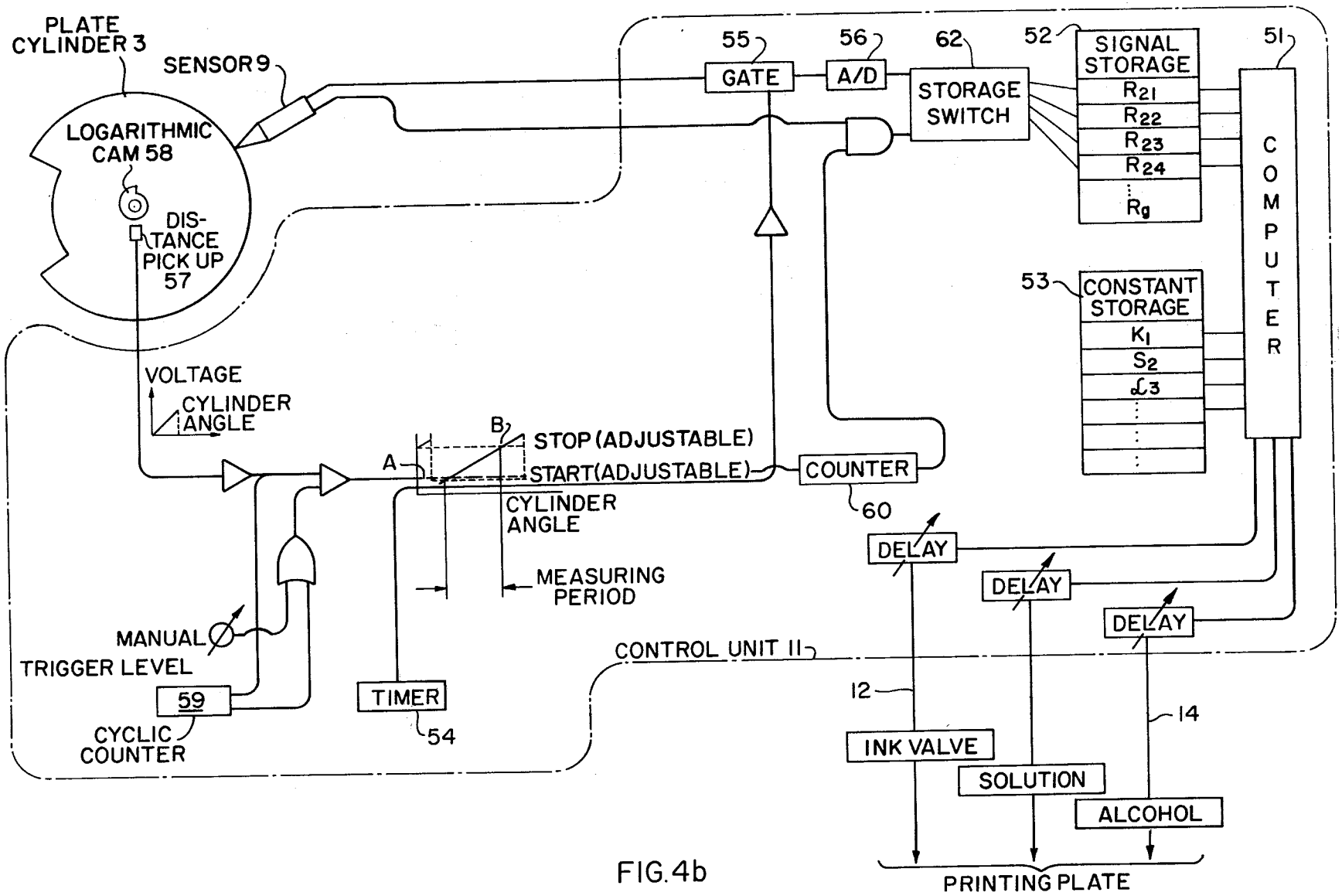

FIG. 2*a* is a plan view of filter wheel 27;

FIG. 3 is a diagrammatic view of another embodiment of the invention similar to that of FIG. 2 showing a different disposition of the components of the measuring head and the control device;

FIG. 4*a* is a schematic block diagram of the control device;

FIG. 4*b* is a more detailed version of FIG. 4*a*; and

Figure 5:
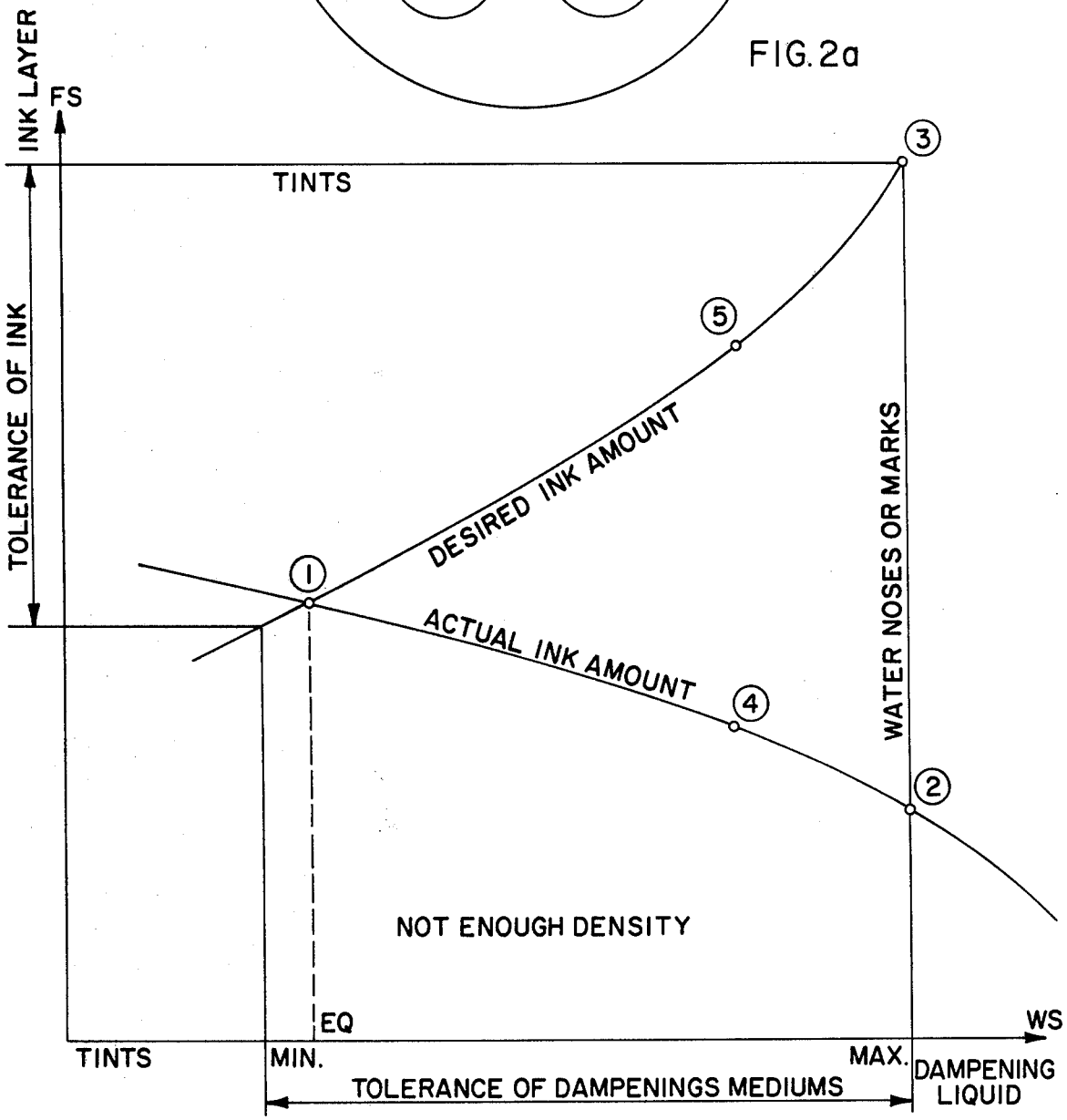

FIG. 5 shows the relationship between the concentration of water and color layers for optimal printing.

Figure 1:
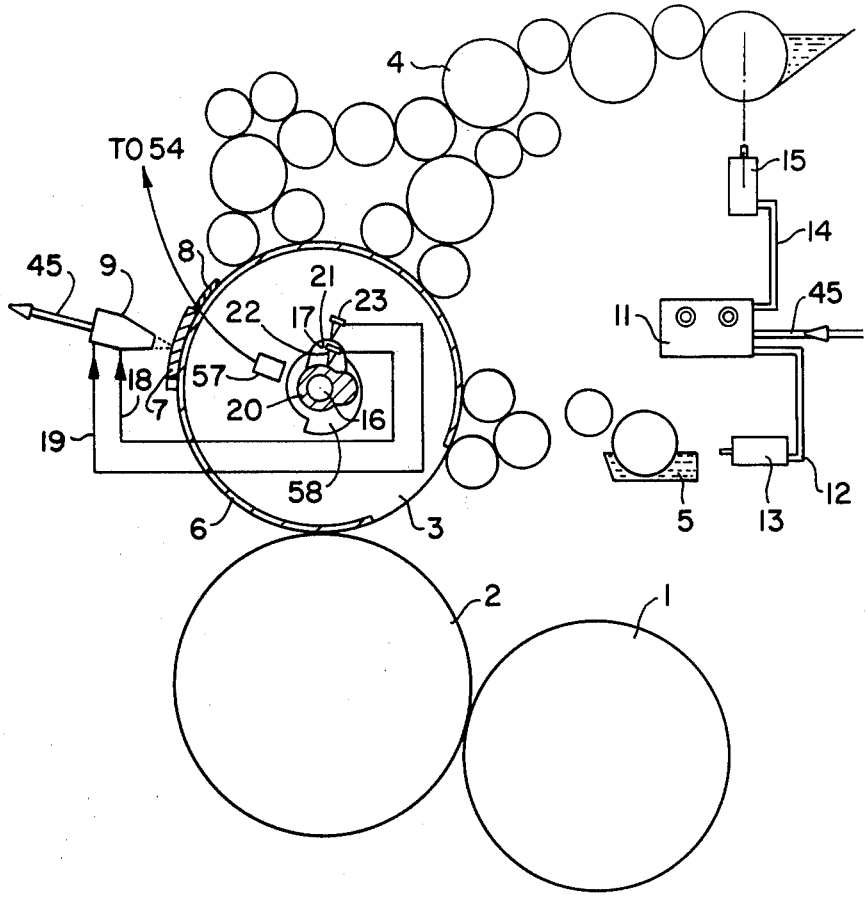
FIG. 1 is a diagrammatic view of an offset printing machine having a measuring and controlling device according to the invention which includes a measuring head, control device, synchronizer and control motors.

Referring now to the drawing and particularly to FIG. 1 thereof, there is shown therein diagrammatically an offset printing machine which includes a conventional impression cylinder 1, a blanket cylinder 2, a plate cylinder 3, and inking mechanism 4 and a dampening mechanism 5. The plate cylinder 3 is covered with an offset plate 6 having chemophysical surface characteristics which determine which surface areas of the offset plate 6 are coated with printing ink and which with liquid. Shown in FIG. 1, and in FIGS. 2 and 3, as well, are a surface area 7 of the offset plate 6 which is wetted with printing ink, and an area 8 thereof that is covered with dampening liquid.

A radiation-operated measuring head 9 is located below the inking mechanism 4 and is directed toward the offset plate 6 of the plate cylinder 3. The measuring head 9 can also be disposed between the dampening and the inking mechanisms instead of the position that is shown in FIG. 1, the measuring head 9 being electrically connected by a line 45 to a control device 11 which regulates a control motor 13 for the inking mechanism 5 through a line 12, and a control motor 15 for the inking mechanism 4 through a line 14.

A synchronizer 17 is mounted on the shaft 16 of the plate cylinder 3 and is electrically connected to the measuring head 9 by lines 18 and 19. The synchronizer 17 is formed of two cams 20 and 21 that are securely mounted on the shaft 16 of the plate cylinder 3 as well as switches 22 and 23 adjustable in circumferential direction of the plate cylinder 3. The synchronizer 17 can also be provided on a single-revolution shaft that rotates in synchronism with the plate cylinder 3. In addition to mechanical signal transmitters, conventional optical or magnetic signal transmitters may also be employed.

As shown in FIG. 2, the measuring head 9 includes inter alia a filter drive motor 25 having a rotary shaft 26 on which a filter wheel 27 as well as a slotted disc 28 are secured. The filter wheel 27 is located directly at the free end of the shaft 26 and contains an ink filter 29, an interference filter 30 for one of the corresponding absorption bands of the dampening medium, and additional filters 29' (FIG. 2*a*) for eliminating disturbing or disruptive quantities.

A light source 31 emitting a complete light spectrum is placed between the filter wheel 27 and the slotted disc 28. The radiation of the light source 31 travels in direction toward the slotted disc 28 through a lens 32 and slots 33 that are formed in the slotted disc 28 and impinges upon three detectors 34, 35 and 36 which are electrically connected by lines 37 with the control device 11, which is not part of the measuring head 9.

In the radiation path 40 of the light source 31 directed toward the filter wheel 27, an additional lens 41 is disposed through which, in the position of the filter wheel 27 illustrated in FIG. 1, light is cast on ink filter 29. The transmitted wavelengths of the spectrum are focussed by a third lens 42 located behind the filter wheel 27 and directed onto the ink layer 7 of the offset plate 6. Radiation 50 reflected from the ink layer 7 impinges on a collector lens system 43 and is transmitted therefrom to a photoelectric cell 44 which is a conventional commercial photo diode, a photo multiplier, a photo resistor or some other means for converting radiation into an electrical signal. In accordance with the intensity of the resulting radiation 50, the photoelectric cell 44 emits a signal, an amplified version of which is fed through line 45 to control device 11. In lieu of a single photoelectric cell 44 it is also possible to use a plurality of photocells, since no single photocell can receive the range of infrared radiation in the spectrum at an equal intensity. As a result of the use of a plurality of photocells it is additionally possible to determine other parameters essential for the quality of the printing process, e.g. the degree of brightness or brilliance of the offset plate.

The block diagram of the control device 11 is shown in FIG. 4*a* and a more detailed version thereof in FIG. 4*b*. The output of photodetector 44 is passed via a line 45 to a gate 55. The duration during which gate 55 is opened i.e. the interrogation or answering period, is determined by a timer 54; the start of this period is, however, determined by a trigger signal derived from synchronizer means 17 including a position indicator 57 through a logarithmic cam 58 indicating the exact position of the plate cylinder 3, with respect to the measuring head 9. A computer-controlled cyclic counter 59 controls both the level and the period of that trigger impulse obtained from the position indicator 57 as well as the length of the measuring period; the higher the trigger level, the greater is the delay of the signal as seen at the output of the gate 55. The trigger level and the ensuing delay are therefore correlated, so that a given trigger level corresponds to a unique position of a particular surface area portion 7 of offset plate 6.

Since the values of the reflected radiation, as seen by photo-detector 44, may fluctuate from one revolution to the next of plate cylinder 3, it may be desirable to arrive at a mean value of reflected radiation by interrogating a specific surface area 7 a multiple number of times and averaging the result, i.e. taking the mean value of the multiple interrogations. The cyclic counter 59 can therefore be set to delay or advance the timer 54, and to decrease or increase the trigger level to achieve the desired number of multiple interrogations of a selected surface area 7. The timer 54 and the counter 59 are connected to the gate 55, the counter 59 being additionally connected to a pulse generator 61 disposed on shaft 16, and accepting trigger inputs therefrom. The output of the gate 55 is fed to an analog-to-digital converter 56, which converts the analog values of the measured signals supplied on lead 45 and passing through gate 55 to digitized values, the output of A/D converter 56 being fed to a signal storage-memory 52. A counter 60, also accepting trigger inputs from the pulse generator 61 disposed on the shaft 16, is connected to the signal storage-memory 52. In the event it is desired to obtain an average, smoothed, or mean measurement value of a number of multiple values, the counter 60 can steer the placement of successive measurement values into respective multiple storage cells $R_{\lambda 1}$, $R_{\lambda 2}$ . . . etc. of the memory 52 by means of a storage switch 62 shown in FIG. 4*b*. The output of the latter is connected to the input of a computer 51, which performs the desired operations on the measured values. An additional stored-constant memory 53 acts as a storage for values fed thereto from either line 37 or entered manually, memory 53 being also connected to the input of computer 51, a feed-back connection from the latter being connected to memory 53. The output of computer 51 is fed to line 12 and 14, and therefrom to respective control motors 13 and 15.

It is the task of control unit 11 to accept successive measurements $R_1$, $R_2$ . . . $R_n$ fed thereinto from line 45, to correct these measurements making allowance for such variables of the measured material as its coefficient of absorption, coefficient of scatter, degree of reflection of an unlayered support, temperature thereof and the like. The appropriate aforesaid variables are fed into the stored-constant memory 53, operated on by computer 51 having a selectable feed-bck control path to memory 53, and compared to the nominal value stored in memory 53; the resultant difference signal is fed to line 14 and therefrom to control motor 15 appropriately actuating the latter.

Control device 11 is provided with data entry keys 46 for entering data and with an indicator 47 for selectively displaying entered data.

FIG. 3 illustrates a modification in the construction of the measuring head of FIG. 2. In this case, the synchronizer 17 is directly connected through the lines 18' and 19' to the control device 11' and not to the filter drive motor 25'. The switchover of the filter wheel 27' is consequently effected in the embodiment of FIG. 3 through the control device 11', for example, by an appropriate entry key 46'. Control device 11', although not part of the measuring head 9', is yet electrically connected through lines 48 and 49 to the filter drive motor 25'.

Only lens 41' is disposed in the radiation path 40' of light source 31. The radiation 50' reflected from the surface of the offset plate 6 impinges on the ink filter 29 and, after the filtering process, on collector 43', constructed as a concave mirror, which focusses rays 50' and re-transmits them to the photoelectric cell 44'. The electrical signals produced by photoelectric cell 44' are transmitted through the line 45' to the control device 11' and amplified.

To explain the operation of the aforedescribed device, it is necessary once again to reconsider the problem solved by the invention. The printing quality of the final product depends to a great extent both upon the ink supplied by the inking mechanism as well as on amount of the dampening means furnished by the dampening mechanism, in fact upon the quantitative ratio of both. If the optimal ink-to-dampening means ratio is disturbed for any reason, for example, due to a greater ink feed as a result of a higher machine operating speed or temperature-dependent changes in viscosity of the printing ink or by the removal of alcohol or other additives from the dampening medium due to evaporation, undesired flawed tones or tints result on the printed sheets when tolerances are exceeded, or so-called "water noses" appear. Both cause print rejects i.e. the accumulation of waste paper.

Such waste paper accumulation is avoided by means of the aforedescribed measuring and control device which is automatically adjustable to at least three operating conditions. In the operating condition of FIG. 2, the measuring head 9 and the control device 11 have been set for ink measurement from the synchronizer through the cam 21 and the switch 23. Accordingly, the surface area 7 of the offset plate 6 is located within the range of the radiation of the measuring head 9, and is covered with ink, in this case with blue ink. Synchronizer 17 transmits to filter drive motor 25 in measuring head 9 a switching or control pulse as a result of which filter wheel 27 is rotated to a position where a red filter 29 is disposed in the radiation path 40 of the light source 31. Simultaneously, that network portion of control device 11, used for short-term ink measurement, is switched in through, for example, detector 36.

As mentioned hereinabove, light source 31 emits the entire light spectrum. The red filter 29, however, transmits only that part of the radiation which is absorbed by the cyanide (blue) ink layer 7 to be measured, that is the red radiation. A definite, although very small, percentage of the impinging red radiation is, however, re-transmitted, and focussed by the collector 43 to ray path 50, and directed to the photoelectric cell 44.

In accordance with the intensity of the radiation 50 impinging on the photoelectric cell 44, a measuring signal is sent through the line 45 to the control device 11. An electronic device in the control equipment 11 removes disruptive or disturbing elements from this measuring signal and then compares the measuring signal with the empirically determined and stored nominal value. If the measuring signal deviates from the nominal value by an amount exceeding a predetermined tolerance range, a control signal is furnished by control device 11 to control motor 15 through the line 14, and the ink feed is varied so that the measuring signal promptly re-approaches the nominal value.

The measuring of the ink is continued as long as the rays 40 emanating from the measuring head 9 sense or scan the ink complex to be measured. The setting or position of the switch 23 of the synchronizer 27 adjustable in circumferential direction of the plate cylinder 3 determines the beginning and the end of the ink measuring operation.

The switch 22 of the synchronizer 17 of FIG. 1 is similarly adjustable in circumferential direction of the plate cylinder 3. It is adjusted so that upon actuation by means of cam 20, rays 40 of measuring head 9 sense or scan a surface 8 of the offset plate 6 wetted by the dampening liquid.

When the switch 22 is actuated by cam 20, the filter drive motor 25 turns the filter wheel 27 through a predetermined angle, and the interference filter 30 for filtering out the absorption bands of the dampening medium is then disposed in the radiation path 40. Simultaneously, through slots 33 and detectors 35 and 36, the network portion of control device 11 measuring the dampening liquid is switched on. The signal than transmitted by photoelectric cell 44 is similarly cleared of disturbing influences electronically and compared with the nominal value. In the event of a deviation, control motor 13 is started changing the liquid feed for bringing the measured signal into coexistence with the nominal value.

Upon control of the ink and dampening liquid layer, measuring head 9 each time switches over its function to measuring disturbing or disruptive effects; in the case, illustrated drive motor 25 rotates filter wheel 27 into a position wherein filter 29' is interposed into the path of rays 40. This filter is made to transmit the particular part of the spectrum which is, for example, determined by the plate surface and the temperature, but not by the ink and dampening liquid layer. In synchronism with the filter wheel 27, the slotted disc 28 is also rotated so that the light source 31 irradiates the detectors 34, 35 and 36 through three slots 33, also causing the smoothing network of control device 11 to be switched in.

The measuring and control device according to the invention thus controls any disruptive or disturbing effects for a given rotation interval of the plate cylinder, and controls the ink and dampening liquid layer only in relatively small surface areas. With an arrangement of three detectors 34, 35 and 36, eight different filters, several ink filters or also a filter for alcohol can, for example, be provided in filter wheel 27, $2^3$ or eight slot combinations being available thereon. Also mutually exchangeable filters, preferably ink filters, can be disposed in filter wheel 27.

Although only two specific embodiments of the invention have been described herein, it should be noted that the filter holder need not necessarily be rotatable, but may be guided in a translatory fashion by a suitable mechanism.

Alternatively also, a single control value, such as the proportion of ink to water together with the tolerance limits thereof can be adopted. Basically, several disturbing or disruptive factors can also be separately determined if filters suitable therefor are made available.

Neither is the invention limited to a single photoelectric cell. If necessary, several photocells could be disposed sequentially in the reflectance radiation path in a manner similar to the disposition of the filter, or in parallel, as has already been discussed.

The scope of the invention can also be enlarged in another direction. The measuring location is not limited to an area within a specific peripheral line. If the measuring head 9 is displaced in an axial direction on a guide through conventional means such as by a cable or by a rack and pinion, every desired point is approachable manually or mechanically.

The attachment of adjusting means such as of control motors 13 and 15 is not limited to doctors that control the entire level. Individual ink adjusting screws or water valves or a nozzle dampening mechanism can be controlled just as well. The control device need then only ensure synchronization between the measuring location and the control station.

Examples of the operation of the control device will now be provided. These relate to:

(a) Applying a correction factor to the reflected rays taking into account the condition of the surface plate, absorption, temperature and the like and smoothing, if necessary, the resultant value;

(b) relating the measured and corrected parameters for ink and dampening means and, if necessary, any additional layer components to each other; and (c) determining the final control value supplied to the control motor.

Examples relating to the application of a correction factor and/or smoothing of the received radiation measurements follow:

EXAMPLE I

Measurement of the reflection degree R of a pigmented layer of arbitrary thickness.

$$R = \frac{1 - R_o[a - b\coth(bSX)]}{a - R_o + b\coth(bSX)} \quad (1)$$

where $$a = K/S + 1, \text{ where } K/S = \frac{(1 - R\infty)^2}{2R\infty} \text{ (specific to a color)}$$

$$b = \sqrt{a^2 - 1}$$

$K$ = absorption coefficient
$S$ = coefficient of scatter
$R_o$ = degree of reflection of a non-layered support
$X$ = thickness of layer $R\infty = R_x \longrightarrow \infty$ = reflection degree of a layer sufficiently thick for the support to have a negligible influence thereon.

See Gall, L., Farbmetrik auf dem Pigmentgebeit, Badische Anilin & Sodafabrik AG, pp. 8–10.

From (1) it will be seen that measured parameter R may change, even though the thickness of layer X remains constant, or vice versa, particularly if any of the parameters $R_o$, a, or b vary. Equation (1) if easily programmable into control device 11.

EXAMPLE II

For the infrared region of the spectrum the degree of absorption $a_{\lambda T}$ (corresponding to the absorption coefficient K) is dependent on the direction of the ray, as well as on temperature and wavelength. The coefficients of scatter of the measurement and reference rays respectively vary in dependence on the wear of the offset plate, different offset plates again showing a different degree of wear. For a vertical ray incidence a theoretical relation between the degree of absorption of metals and the wavelength is only known for the infrared region of the spectrum, but not for the visible region of the spectrum, so that such a relation must be found empirically. (See Kohlrausch, F., Praktische Physik, B. G. Teubner, Stuttgart, 1968, pp. 253–254). Thus, $$\alpha_{\lambda T} = 0.356 \cdot r/\sqrt{\lambda} \cdot T \quad (2)$$

$\lambda$ = wavelength in cm of the incident ray;

r = specific resistivity of the metal in ohms·cm;

T = absolute temperature.

It will be noted that $\alpha_{\lambda T}$ is therefore a function of both r and T.

$\alpha_{\lambda T}$ does not change very much, however, in the visible region of the spectrum, as a function of temperature. Any change of $\alpha_{\lambda T}$ and its dependence in relation to wavelength can only be ascertained from measurements.

Control device 11 can compute $\alpha_{\lambda T}$ for the measured ray $\alpha$ meas and for the reference ray a $_{ref}$, and store the respective values in stored-constant memory 53.

If a broad band JR filter is inserted into filter wheel 27, control device 11 can compute the temperature of the offset plate according to kirchhoff and the well-known Stefan-Boltzmann law, the offset plate being considered a "gray" radiator. Since, as has already been stated, $\alpha_{\lambda T}$ corresponds to K, control device 11 can program the correction found from equation (2) into equation (1).

EXAMPLE III

The reflected radiation, coefficient of scatter S and coefficient of absorption K are characteristically a function of both the radiated wavelength and the specific properties of the material investigated. In the infrared region, with very few exceptions, only the effect of absorption is important. In the case of very thin layers, furthermore, multiple reflections may have to be taken into account. It has been shown that for a layer of a thickness of $10^{-4}$ cm = 1 $\mu$m (approximately the thickness of the dampening or moistening layer on the plate) an error in the calculated reflectance for tetracarbon chloride occurs amounts to 30% in the region of the fundamental wavelength, i.e. 2 - 30 $\mu$m. (See Brügel, W., Einführung in die Ultrarotspektroskopie, Steinkopff, Darmstadt, 1957.)

Relating now to the specific case of determining thickness of dampening means on offset plates, it is clear that an error or deviation in both the measurement ray and the reference ray may occur, and that these errors or deviations may even differ from each other, since they are a function of $\lambda$. Any such error or deviation is purely a function of the material itself, predeterminable in the laboratory and programmable into the computer.

The corrected reflection degree $R_{corr}$ can be obtained from the formula according to Reule:

$$R_{corr} = \frac{R - (1 - \alpha g) \cdot r_a}{1 - r_a - r_i \cdot (1 - R - \alpha \cdot g \cdot r_a)} \quad (3)$$

where

R = measured reflection; note that the effectivity $\alpha$ of a brightness or brilliance trap = 1, if fully effective, and $\alpha$ = 0, if not used or not effective, i.e. measurement includes brightness or brilliance;

g = degree of brightness or brilliance of the sample;

$r_a$ = coefficient of surface reflection of the sample (e.g. 0.04); and $r_i$ = coefficient of inner reflection of the sample (e.g. 0.6).

The degree of brightness or brilliance g of the offset plate can be supervised by a supervisory ray $\lambda_g$ and taken into account by control device 11.

The degree of reflection can so be computed from (3). The thickness of the layer X, can then be found from (1)

$$X = \frac{e^{\frac{2B}{b}} + 1}{e^{\frac{2B}{b}} - 1} \cdot \frac{1}{b \cdot S} \quad (4)$$

$$B = \frac{R(a - R_o) - 1 + aR_o}{R_o - R} \quad (5)$$

e = base of the natural logarithm, the remaining symbols having already been defined in Example I.

Control device 11 computes the difference between successive corrected values $R_{corr}$ and either values already entered into the stored-constant memory 53 of the computer or a new nominal value. The resultant delayed difference is then supplied to the respective position control means of the color - and dampening-liquid supply means of the offset printing press, a certain delay being necessary to ensure stable control. The necessary delay is a function of the specific construction of the control circuit, and is also programmable into the computer.

It will, of course, always be necessary to program appropriate theoretical formalae, as well as empirically found constants applicable to individual cases into the computer of control device 11.

Interrelation of parameters.

EXAMPLE IV

It is known that the ink color of the finished print can be changed as a result of a variation of either manual color supply only, as well as a result of a variation of the supply of dampening means. It is customary to only adjust the color supply, and not the dampening means, since the human eye is not able to differentiate very well any change occurring in the water supply.

Actual experiments have shown, however, that a change in one parameter, for example a decrease in the color supply, also results in a change of the thickness of the dampening means on the plate and vice versa. The degree of such interdependent influences is a function of the duration of the previous state, and also influences the "dead interval" or "play" of the control circuit. An explanation can be found in the degree of absorption for the amount of water supplied. This is illustrated in the example discussed below, the concentration of the water layer being shown on the abscissa of FIG. 5, the ordinate showing the concentration of the color layer.

The offset printing press according to the invention operates satisfactorily at a given concentration of the respective color-and water layers, shown in FIG. 5 as point 1. If the printer is below the region shown as "min." and consequently uses less water, then a smearing effect occurs on the plate, proper printing no longer being possible. If, however, too much water is added and the point shown as "max." is exceeded, then so-called "water marks" arise. Both deficiencies result in wastage of prints; the printer must therefore stay within the "min." and "max" limits, the so-called moisture of dampening tolerance limits, that size of that region being a function of the color used and of the prevailing temperature. If for any reason an excess of water is supplied, the color layer decreases, as has been shown by experiments. That decrease is shown by the curve extending from point 1 to point 2. Additional experiments have shown that the printer must then add an additional amount of color in order to obtain a good print, that addition being shown by the curve connecting point 1 to point 3.

If, as a result of wear of the plate or as a result of an increase in temperature the "min" boundary is displaced somewhat to the right i.e. the plate "smears", than the printer must add water, and this corresponds to point 4, the plate becoming clean. The printer must additionally increase the color supply to a level 5 in order to print optimally. The aforesaid process is achievable automatically according to the present invention.

I claim:

1. A device for automatically controlling deviations in a liquid ink and dampening liquid feed in an offset printing press having a plate cylinder carrying an offset plate having a surface wettable by liquid ink and dampening liquid fed thereto, comprising a measuring head including a radiation collector and a photoelectric cell, a light radiation source disposed in said measuring head having a light path directed toward the offset plate of the plate cylinder, a plurality of filters in said measuring head for transmitting only given wavelengths of the radiation source spectrum, adjustable synchronizer-means for switching on and off said light radiation source in synchronism with rotation of the plate cylinder mounted on a single-revolution shaft rotatable in synchronism with the plate cylinder, means for alternatingly introducing said filters into said radiation path, said filter-introducing means comprising a filter drive motor having a rotary shaft, a filter wheel mounted on a free end of said filter drive motor shaft for securing said filters therein, said filters being selectively pivotable into the radiation path of said radiation source as said filter drive-motor shaft rotates, individual measuring intervals being selectable by said synchronizer means, said radiation collector focusing radiation reflected from the wetted surface of the plate cylinder and directing the same to said photoelectric cell, control means for receiving a signal emitted by said photoelectric cell in accordance with the intensity of the relected radiation directed thereto, and adjusting means for adjusting the feed of the liquid ink and dampening liquid to nominal values in response to said control means, a slotted disc also mounted on said filter drive-motor shaft, said radiation source being disposed between said filter wheel and said slotted disc, and said slotted disc being disposed between said radiation source and a plurality of detectors located adjacent in a radial direction of said slotted disc, said detectors being electrically connected to said control means in order to switch on and off said control means for said ink and dampening liquid feeds and for the removal of disturbing elements from the signal emitted by the photoelectric cell.

* * * * *